US005672027A

United States Patent [19]

Wadensten

[11] Patent Number: 5,672,027

[45] Date of Patent: Sep. 30, 1997

[54] REVERSIBLE PLATE COMPACTOR HAVING AN IMPROVED DRIVE AND DIRECTIONAL CONTROL

[76] Inventor: Theodore S. Wadensten, 75 Stillson Rd., Wyoming, R.I. 02898

[21] Appl. No.: 698,170

[22] Filed: Aug. 1, 1996

[51] Int. Cl.[6] ..... E01C 19/30

[52] U.S. Cl. ..... 404/133.05; 74/574; 74/573 R

[58] Field of Search ..... 404/133.05, 133.01, 404/114, 118, 103, 117; 425/218, 425, 456; 299/37.2; 74/61, 87, 574, 573 R

[56] References Cited

U.S. PATENT DOCUMENTS 5,439,314 8/1995 Wadensten ..... 404/133.1

*Primary Examiner*—David J. Bagnell
*Assistant Examiner*—Tony Boyd
*Attorney, Agent, or Firm*—Patrick J. Pinto

[57] ABSTRACT

A self-propelled and reversible compactor 10 includes a motor 12, a motor mounting plate 14, a tamper plate 16, a vibrator assembly 30, a driven pulley 38, a drive pulley 48, and a directional control arm 54. The vibrator assembly 30 is pivotally attached for selective pivotal positioning of a vibrator housing 36 of the vibrator assembly 30 at a first end 26 or a second end 28 of the compactor. The driven pulley 38 is mounted on a shaft 34 of the vibrator housing 36. The directional control arm 54 provides a manually operated control for providing the selective pivotal positioning of the vibrator housing 36. An endless flexible belt transmits the power from the drive pulley 48 to the driven pulley 38. Components mounted on the engaging end 58 of the directional control arm 54 engage one of the two tangential strands of a flexible endless belt 52 for pivotally displacing the vibrator housing 36 from the first end 26 to the second end. This pivotal displacement controls the direction of self-propelled movement of the compactor 10.

12 Claims, 3 Drawing Sheets

REVERSIBLE PLATE COMPACTOR HAVING AN IMPROVED DRIVE AND DIRECTIONAL CONTROL

BACKGROUND OF THE INVENTION

1. Field of the Invention

With regard to the classification of art, this invention is believed to be found in the general class entitled Road Structure, Process and Apparatus and more particularly to those subclasses pertaining to reversible drives that combine a drive and directional control means.

2. Description of Related Art

Reversible compactors are well known in the art. The only known pertinent prior art is U.S. Pat. No. 5,439,314, that issued to Wadensten on Aug. 8, 1995, disclosing a reversible compactor. U.S. Pat. No. 5,439,314 discloses a compactor that is reversible by pivotally displacing a single vibrator housing from one end of a tamper plate to the other. U.S. Pat. No. 5,439,314 is solely owned by the inventor of the present invention.

The laboratory testing and experimental commercial use of the apparatus that is disclosed in U.S. Pat. No. 5,439,314 has revealed several desired needs. Those needs, identified below, include: the need for a directional control that is convenient and easy to use; any improved directional control should also provide movement of the vibratory housing in a substantially safe manner for the operator; and the needed directional control should also be economically feasible.

The present invention solves the identified needs while providing additional benefits such as: ease of maintenance, a minimum of rotating parts, and a minimum of drive components. Other benefits will become apparent in the disclosure that follows.

SUMMARY OF THE INVENTION

The present invention may be briefly described as: a reversible self-propelled plate compactor comprising a tamper plate, a motor, a mounting plate, a drive means, a driven means, a vibratory assembly, a drive belt and a direction control arm.

The tamper plate has a tamper side for contacting material to be compacted. The motor is carried on the mounting plate. The mounting plate is selectively shaped or contoured and resiliently attached to the tamper plate for isolating the mounting plate and the motor from the tamper plate. The drive means is removably attached to an output shaft of the motor The vibratory assembly includes a weight that is eccentrically carried on a vibrator shaft for imparting vibratory motion when rotating by way of the driven means mounted thereon. The driven means is selectively driven by the drive means by way of the drive belt. The drive belt is endless and has a selected pitch length for supporting the vibratory housing in a selected spaced relationship with respect to the tamper plate. The vibratory shaft has selected portions that are journalled in the vibratory housing. The vibratory housing is attached to one end of an arm. The opposite end of the arm includes a pivot means that is arrayed for pivotally attaching the arm to an interior side of the tamper plate. That interior side is opposite to the tamper side. An axis of the pivot means is transverse to a direction of self-propelled movement for allowing selective displacement of the vibratory housing from a first end to a second end of the compactor.

The direction control arm includes a grasping end, an engaging end; and a center of rotation. The engaging end is distal to the grasping end and has an engaging means attached thereto. The center of rotation is selectively positioned with respect to the grasping end and the engaging end. That canter of rotation is further arrayed for pivotally attaching the direction control arm to a selected portion of the plate compactor so that the engaging means is positioned between with the drive means and the driven means, The engaging means is also positioned between the tangential strands of the drive belt for selectively engaging one of those strands of the drive belt. The directional control arm is manually and selectively pivoted about the canter of rotation for engaging and urging the selected strand of the drive belt by and with the engaging means while simultaneously maintaining engagement of the drive belt with the drive means and the driven means. That urging of the selected strand of the drive belt causes the vibratory housing and the driven means to pivot about the axis of the pivot means so that the vibratory housing is selectively positioned near the first end or the second end of the compactor thereby moving the compactor in a desired direction of travel during motor operation.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best mode for the present invention. These specific embodiments, as shown in the accompanying drawings, may also include diagrammatic symbols for the purpose of illustration and understanding.

Figure 1:
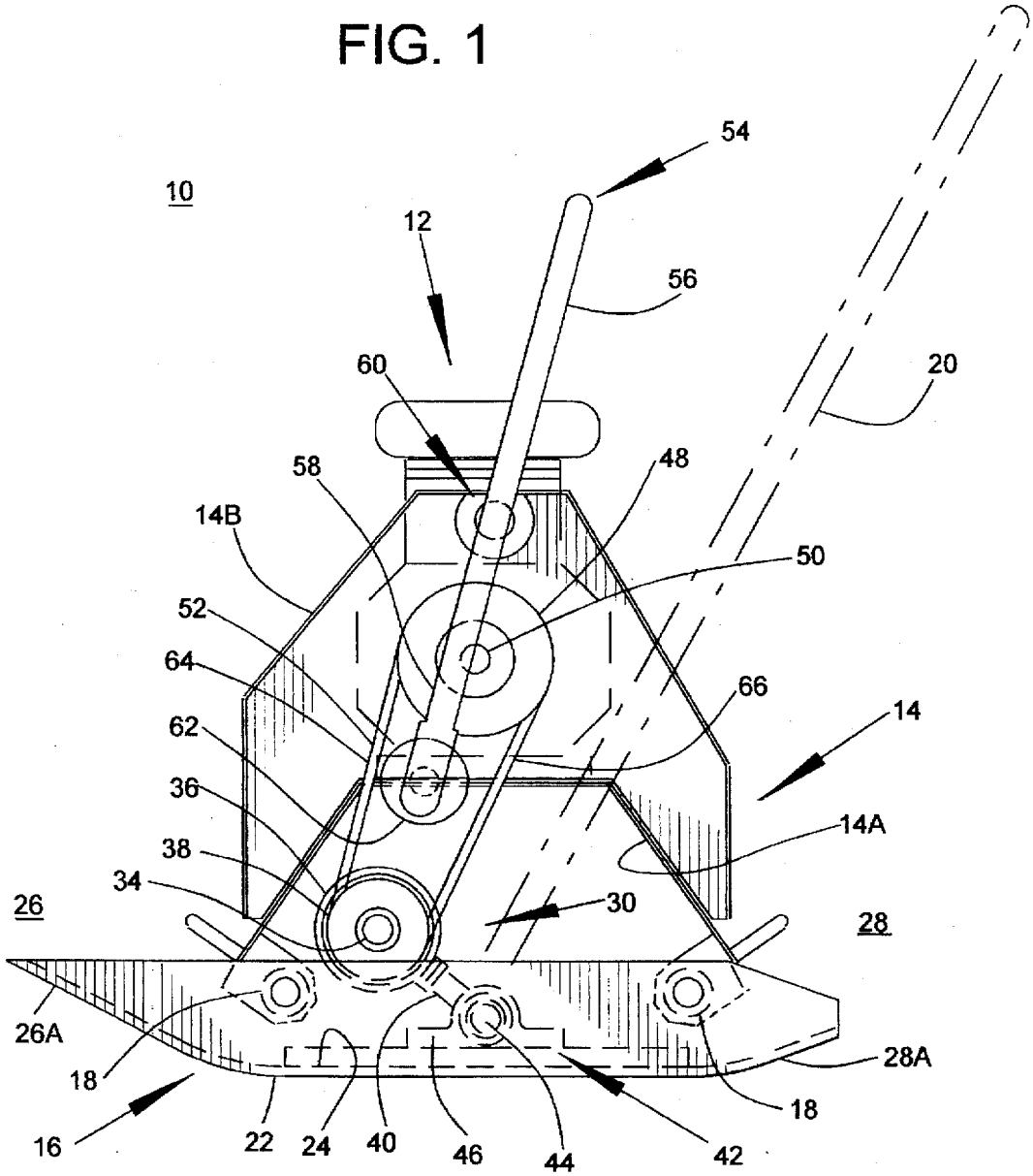
FIG. 1 represents a front elevation of a reversible compactor of the present invention.

In the following description and in the appended claims, various components and/or elements are identified by specific names for convenience. These names are intended to be generic in their application while differentiating between the various components. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

Figure 2:
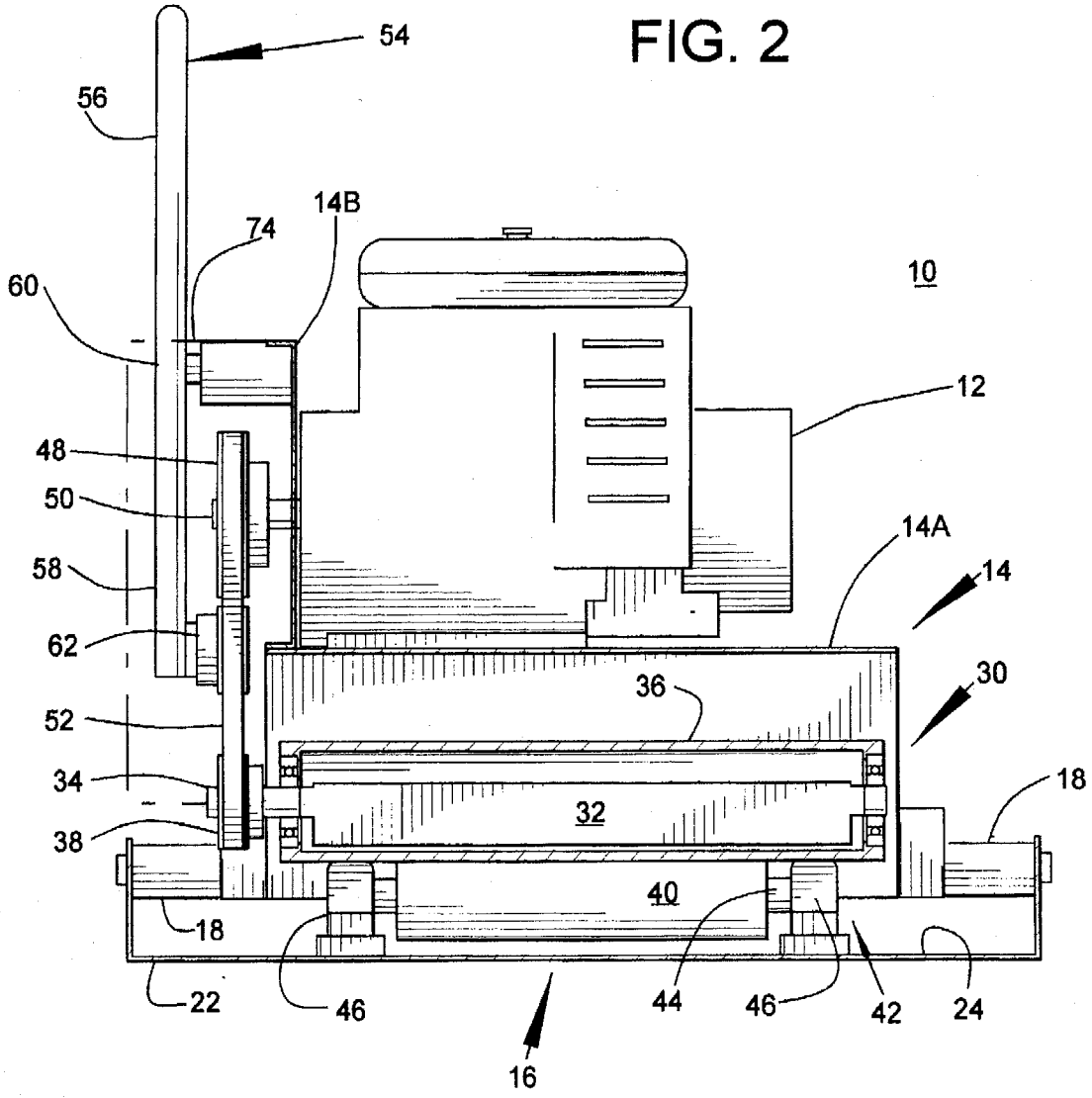
FIG. 2 represents a side elevation, partly in section, of the present invention.

Referring first to FIGS. 1 and 2, a plate compactor is generally identified as 10. The plate compactor 10 includes a prime mover or motor 12 that is removable fastened to a shaped mounting plate 14. The mounting plate 14 preferably includes a horizontal portion 14A and a vertical portion 14B. The shaped horizontal portion 14A and the shaped vertical portion 14B may be formed as one piece or as separate pieces that are attached by screws, welding or the like. It is preferred that the motor 12 be an internal combustion engine. However, the use of alternative types of motors such as electric, pneumatic, or hydraulic motors may be substituted.

The mounting plate 14 is selectively shaped and resiliently connected to a tamper plate 16 by a plurality of isolation mounts 18. A guide means 20 such as a handle, that is shown in dashed outline, is attached to the compactor 10. The guiding means 20 is used for manually guiding or directing movement of the plate compactor 10. The guiding means 20 may be adapted for rigid or pivotal attachment to the plate compactor 10. The guiding means 20 may also be provided with an intermediate joint for folding the handle during transportation or storage. The compactor 10 may include a pair of lifting handles that are attached near the lower end portions of the mounting plate 14A.

It is preferred that the motor 12 be mounted to the plate compactor 10 for the substantially uniform distribution of its weight on the surface to be compacted by the tamper plate 16. The tamper plate 16 includes a tamper side 22, an opposite side 24, a first end 26 and a second end 28. The first end 26 and second end 28 preferably include inclined portions 26A and 28A respectively.

Referring in particular to FIG. 2, a vibrator assembly 30 includes a weight 32 that is eccentrically carried on a vibrator shaft 34. Selected portions of the vibrator shaft 34 are journalled in the ends of the vibratory housing 36. At least one end of the vibratory shaft 34 extends a selected distance beyond its associated end of the vibratory housing 36 for providing an attachment portion for a driven means 38, such as a v-belt pulley, sheave and the like.

Referring again to FIGS. 1 and 2, the vibratory housing 36 is attached to one end of a pivot arm 40. The opposite or distal end of the pivot arm 40 includes a pivoting assembly or means 42. The pivoting assembly 42 includes a pivot shaft 44 and a pair of journals 46 such as sealed pillow block bearings and the like that are commercially available and easily serviced. The axis of the pivoting assembly 42 is transverse to the direction of reversible sell-propelled movement of the compactor 10. It is also preferred that the pivot axis be centrally located with respect to the tamping surface of the tamper plate 16. This pivoting assembly 42 may also include noise suppression mountings. The pivot shaft 44 may include shouldered ends or retaining means for maintaining a positive shaft location.

A drive means 48 is removably attached to an output shaft 50 of the motor 12. The power is transmitted from the drive means 48 to the driven means 38 by way of a flexible endless belt 52, such as a v-belt, a poly-v-belt, a plurality of matched v-belts, double v-belt or the like but not limited thereto. The endless belt 52 should have a pitch length that will support and position the vibrator housing 36 at a selected spaced relationship with respect to the tamper plate at either the first end 26 or the second end 28.

The vibrator assembly 30 is selectively positioned at the first end 26 or the second end 28. The selected position should provide a desired combination of self-propelled movement with compacting forces. A discussion of the effects of the angular position of the vibrator housing 36 with respect to a surface to be compacted was presented in U.S. Pat. No. 5,439,314. As noted above, U.S. Pat. No. 5,439,314 was issued to and is solely owned by the present inventor. The disclosure of U.S. Pat. No. 5,439,314 is incorporated into this application by reference, to the extent allowed by present law.

A directional control arm or lever 54 includes a grasping end 56, an engaging end 58, and a center of rotation 60. Preferably the engaging end 58 includes an engaging means 62. It is preferred that the engaging means 62 include an idler sheave or v-belt pulley or the like. Alternatively, other engaging means 62 may be used such as a disk member, elongated rod or the like. The center of rotation 60 is preferably located intermediate the grasping end 56 and the engaging end 58. The directional control arm 54 is pivotally attached to the mounting plate 14. It is preferred that this attachment point place the directional control arm 54 so that the grasping end is easily reachable by an operator, while simultaneously positioning the engaging end 58 intermediate the drive means 48 and the driven means 38. The selected attachment point must also place the engaging means 62 between the first tangential strand 64 and second tangential strand 66 of the flexible endless belt 52.

The drive tension for the endless belt 52 is provided and maintained by the weight of the vibrator assembly 30 while absorbing any am like movement encountered therein.

Figure 3:
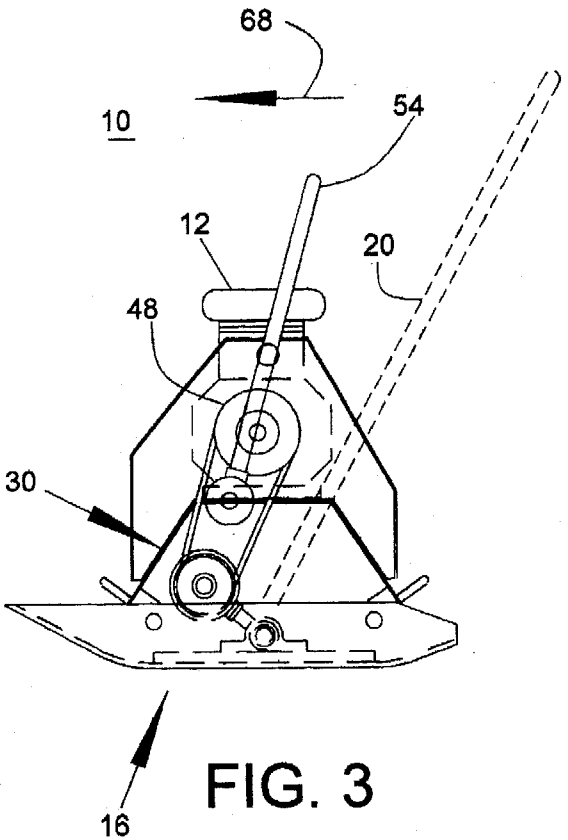
FIG. 3 represents a front elevation in a reduced scale, showing a first driving position for the vibratory housing prior to movement by the directional control arm.

Referring now to FIGS. 3, the plate compactor 10 of the present invention is depicted as being configured for self-propelled motion in the direction of the arrow 68. The vibratory assembly 30 provides the directional movement as well as the compacting forces.

Figure 4:
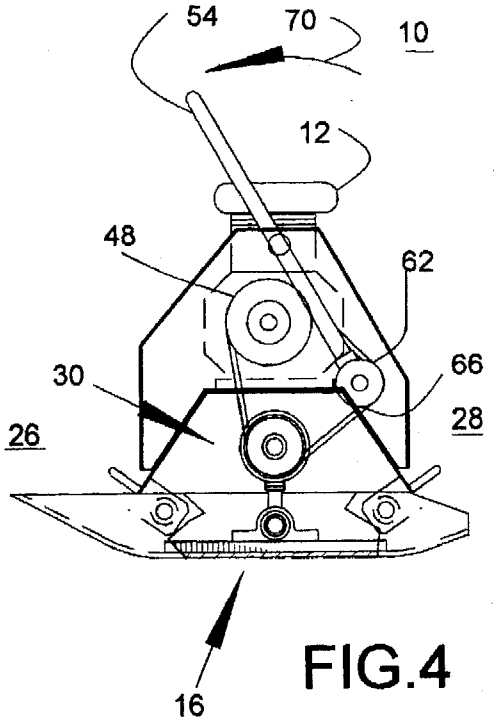
FIG. 4 represents a front elevation in the scale of FIG. 3, with a portion of the tamper plate broken away. This view showing the vibratory housing at a transitional position during its movement by the directional control arm from one end of the tamper plate to the opposite end.

Referring now to FIG. 4, the present invention is depicted as being at a substantially instantaneous or momentary idle position that provides little or no self-propelled directional movement. As depicted, the directional control arm 20 is being moved from end 28 to end 26 in the direction of the arc-like arrow 70. The engaging means 62 contacts the second strand 66 causing a pivoting force on the vibratory assembly 30. This pivoting force moves the vibratory assembly 30 from the proximity of the first end 26 towards and to the second end 28.

Figure 5:
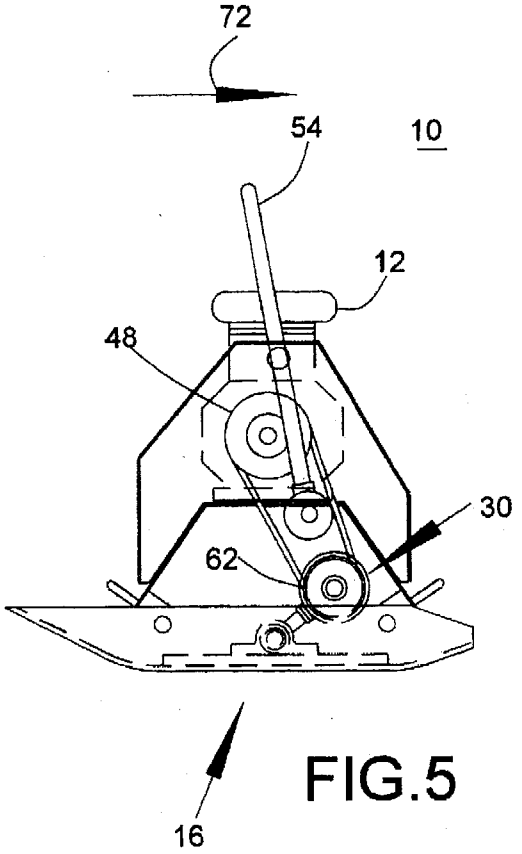
FIG. 5 represents a front elevation in the scale of FIG. 3, showing a second driving position for the vibratory housing after being moved by the directional control arm.

Referring now to FIG. 5, the compactor of the present invention is depicted as being configured for self-propelled movement in the direction of arrow 72. This direction 72 is reverse to the direction 68 that is depicted in FIG. 3.

When the operator desires to again reverse the direction of self-propelled movement, the directional control arm 20 is moved in a direction opposite to arrow 70. This action will return the vibrator housing 30 to end 26 thereby causing movement in the direction of arrow 68.

It is to be noted that the attachment of the drive means and the driven means should be made by a removable means such as a clamp-type or tapered hubs. This type of hub provides positive attachment during the compacting action.

It is also to be noted that the arrangement of components of the present provides for the mounting of safety guards 74 for protecting the operator. The safety guard is depicted in dashed outline in FIG. 2. This provision allows change of direction while the motor is in operation.

It is also to be noted that the velocity of self propelled movement may be controlled by the selected pitch length of the belt. For example a longer pitch length would provide a smaller included angle that would be formed by the position of the vibratory assembly with the compacting surface. This would increase the velocity of self-propelled movement. It is also to be noted that the velocity may alternatively be controlled by movement of the directional control arm 54.

The directional control arm may be locked at intermediate positions for supporting the vibratory housing at a desired included angle.

It can also be seen that the present invention is easily operated, serviced and maintained.

Directional terms such as "front", "back", "in", "out", "downward", "upper", "lower" and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A reversible self-propelled plate compactor comprising:

a) a tamper plate having a tamper side for contacting material to be compacted;

b) a motor carried on a mounting plate, said mounting plate being selectively shaped, said mounting plate being resiliently attached to said tamper plate for isolating said mounting plate and said motor from said tamper plate, said motor having a drive means attached to an output shaft;

c) a vibratory assembly including a weight being eccentrically carried on a vibrator shaft for imparting vibratory motion when rotating by way of a driven means mounted thereon, said driven means being selectively driven by said drive means by way of a drive belt, said drive belt having a selected pitch length, said vibratory shaft having selected portions being journalled in a vibratory housing, said vibratory housing being attached to one end of an arm, the opposite end of the arm including a pivot means, said pivot means being arrayed for pivotally attaching the arm to an interior side of the tamper plate, said interior side being opposite to said tamper side, an axis of the pivot means being transverse to a direction of self-propelled travel;

d) a direction control arm including a grasping end, an engaging end; and a center of rotation, the engaging end being distal to the grasping end and having an engaging means attached thereto; said center of rotation being selectively positioned with respect to the grasping end and the engaging end; said center of rotation being arrayed for pivotally attaching said direction control arm to a selected portion of the plate compactor so that the engaging means is positioned between the drive means and the driven means, said engaging means being also positioned for selectively engaging one of the strands of the drive belt; and wherein the directional control arm is selectively pivoted about the center of rotation for engaging and urging the selected strand of the drive belt by and with the engaging means while simultaneously maintaining engagement of the drive belt with the drive means and the driven means, said urging of the selected strand of the drive belt causing a pivoting of the vibratory housing and the driven means about the axis of the pivot means so that the vibratory housing is positioned near one selected end of a first end and second end of said tamper plate for moving the compactor in a desired direction of travel.

2. A reversible compactor as recited in claim 1 wherein the selected pitch length of the drive belt supports the vibratory housing at the one selected end of the tamper plate while simultaneously providing a spaced relationship of the vibratory housing with respect to the tamper plate.

3. A reversible plate compactor as recited in claim 2 wherein the center of rotation is positioned intermediate the grasping end and the engaging end.

4. A reversible plate compactor as recited in claim 2 wherein a drive tension is maintained on the drive belt by the weight of the vibratory assembly.

5. A reversible plate compactor as recited in claim 2 wherein the engaging means is an idler pulley.

6. A reversible plate compactor as recited in claim 5 wherein a drive tension is maintained on the drive belt by the weight of the vibratory assembly.

7. A reversible plate compactor as recited in claim 5 wherein the center of rotation is positioned intermediate the grasping end and the engaging end.

8. A reversible plate compactor as recited in claim 7 wherein the selected portion of the plate compactor is above the drive means.

9. A reversible plate compactor as recited in claim 1 wherein the engaging means is an idler pulley.

10. A reversible plate compactor as recited in claim 1 wherein the center of rotation is positioned intermediate the grasping end and the engaging end.

11. A reversible plate compactor as recited in claim 1 wherein a drive tension is maintained on the drive belt by the weight of the vibratory assembly.

12. A reversible plate compactor as recited in claim 1 wherein the selected portion of the plate compactor is above the drive means.

* * * * *